United States Patent [19]

Hart

[11] Patent Number: 4,746,155

[45] Date of Patent: May 24, 1988

[54] WORKING TRIM FOR MORTISE LOCK

[75] Inventor: LeRoy Hart, Farmington, Conn.

[73] Assignee: Emhart Industries, Inc., Farmington, Conn.

[21] Appl. No.: 481,030

[22] Filed: Mar. 31, 1983

[51] Int. Cl.[4] ..... E05B 3/00

[52] U.S. Cl. ..... 292/351; 16/DIG. 24; 74/548; 292/353; 292/358; 411/191

[58] Field of Search ..... 292/357, 358, 352, 353, 292/348, 204, 209, 350, 351; 411/192-196, 191; 74/548; 16/118, 121, DIG. 7, DIG. 24, DIG. 25

[56] References Cited

U.S. PATENT DOCUMENTS

| | | | |
|---|---|---|---|
| 196,014 | 10/1877 | Hiler | 292/350 |
| 241,059 | 5/1881 | Phipps | 292/350 |
| 269,516 | 12/1882 | Fox | 292/350 |
| 435,250 | 8/1890 | Sampson | 292/357 |
| 511,185 | 12/1893 | Anspach et al. | 292/348 |
| 649,087 | 5/1900 | Wade et al. | 16/121 |
| 957,837 | 5/1910 | Berry | 292/348 |
| 1,015,765 | 1/1912 | Spring | 292/358 |
| 1,049,055 | 12/1912 | Crowell | 411/193 |
| 1,122,026 | 12/1914 | O'Rourke | 292/204 |
| 1,487,975 | 3/1924 | Riddick | 292/350 |
| 1,877,798 | 9/1932 | Briggs et al. | 292/353 X |
| 1,951,188 | 3/1934 | Flaherty | 292/353 X |
| 1,958,165 | 5/1934 | Le Compte | 16/118 |
| 1,958,363 | 5/1934 | Gold | 292/357 X |
| 2,660,457 | 11/1953 | Mallon | 16/DIG. 24 X |
| 3,036,401 | 5/1962 | Stark | 411/191 X |
| 3,477,309 | 11/1969 | Sprecher | 292/353 X |

FOREIGN PATENT DOCUMENTS

| | | | |
|---|---|---|---|
| 2091 | of 1892 | United Kingdom | 292/350 |
| 167973 | 8/1921 | United Kingdom | 411/195 |
| 946434 | 1/1964 | United Kingdom | 74/548 |

*Primary Examiner*—Lloyd A. Gall

*Attorney, Agent, or Firm*—Barry E. Deutsch

[57] ABSTRACT

Working trim for a lock including an adapter plate mounted on a door. A noncircular spindle extends from the door through the adapter plate. A shank adapter is slidably received on the spindle for rotation therewith and retaining means is provided for axially retaining the shank adapter on the spindle in one direction with the adapter plate retaining the spindle in the other direction. A door operator, such as a knob, is mounted on the shank adapter for rotation therewith.

12 Claims, 1 Drawing Sheet

WORKING TRIM FOR MORTISE LOCK

BACKGROUND OF THE INVENTION

This invention relates generally to working trim for use with locks and more particularly to working trim for use with mortise locks.

In the past, one embodiment of working trim utilized a threaded square spindle which extended out from an adapter plate having a bushing portion thereon which was attached to the door. An internally threaded adjustable shank, on which the door knob was mounted and retained thereon by a knob retainer, was threaded on the spindle until it fit snugly in the bushing. A set screw threadly extended through the shank and was tightened against the spindle with the set screw bottoming against one of the flat sides of the square spindle. In use, by turning the door knob the latch bolt of the mortise lock could be operated due to the interconnection of the knob, adjustable shank, and spindle.

The threaded spindle and shank provided a means for adjusting for various door thicknesses. However, the torque, by repeated turning of the door knob, could result in the set screw damaging the spindle and the knob and shank adapter might loosen up. This problem could be compounded if the set screw was not bottomed on a flat side of the spindle, but rather, bottomed on one of the corners of the square spindle.

SUMMARY OF THE INVENTION

It is the object of this invention to provide an improved working trim for locks.

More particularly, it is an object of the present invention to provide working trim for a lock which does not rely on a set screw to fasten the operator to the spindle.

Yet another object of the invention is to provide working trim for a lock which is less susceptable to wear and the operator becoming loose.

These and other objects of the present invention may be accomplished through the provision of working trim for a lock which includes an adapter plate mounted on a door. A noncircular spindle extends from the door through the adapter plate. A shank adapter is slidably received on the spindle for rotation therewith and retaining means is provided for axially retaining the shank adapter on the spindle in one direction, with the adapter plate retaining the shank adapter in the other direction. The lock operating means is mounted on the shank adapter for rotation therewith.

DETAILED DESCRIPTION

Figure 1:
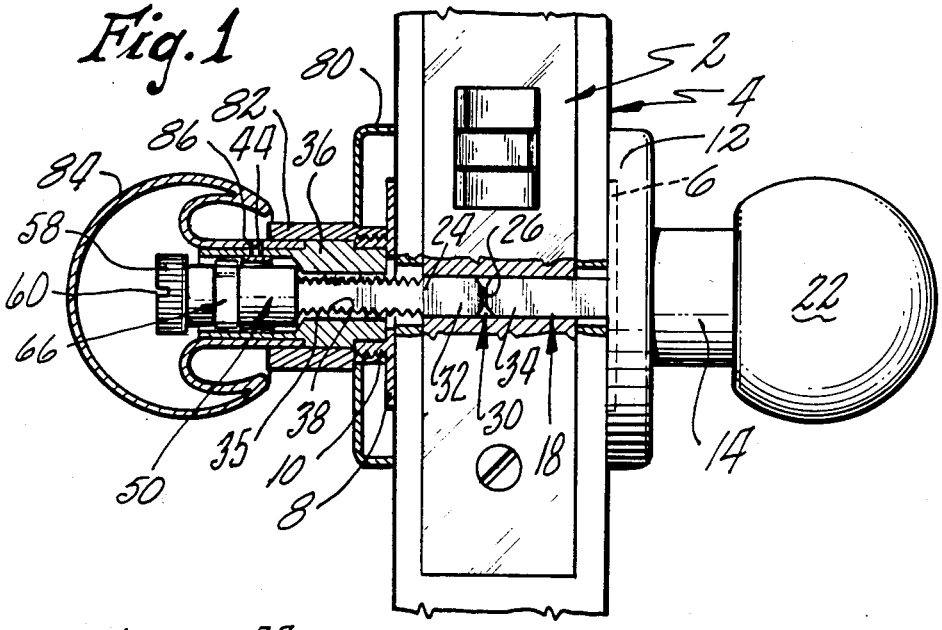
FIG. 1 is a vertical side view, partially in section, of the working trim constructed in accordance with the present invention and showing it in relationship to a door and mortise lock.

Referring to the drawings and in particular FIG. 1, a mortise lock 2 is mounted in a suitable cutout in a door 4. An adapter plate 6 is mounted against the outside face of the door 4 and includes an externally threaded bushing portion (not shown). An adapter plate 8 is mounted against the inside face of the door 4 and also has an externally threaded bushing portion 10.

The right-hand portion of the working trim, as shown in FIG. 1 is conventional and will not be described in great detail. However, it may include a rose or escutcheon plate 12 mounted on the door 4 by means of a sleeve 14 threaded on the bushing portion of the adapter plate 6. A shank adapter 16 is pinned to a swivel spindle assembly 18 by means of a roll pin 20. The outside knob 22 is mounted on the shank adapter 16 by suitable conventional mounting means.

The swivel spindle assembly 18 includes an inside spindle 24 which has a reduced male portion 26 threaded into a threaded bore in the inner end of the outside spindle 28 to which the shank adapter 16 is attached. A gap 30 is provided between the heads 32 and 34 of the two spindles 24 and 28 respectively, to permit one spindle to rotate with respect to the other without binding. The inside spindle 24 has a noncircular cross-section and, in the preferred embodiment, is square with the corners of the spindle 18 from the head portion 32 to the opposite end having threads 35 formed therein to form a threaded, noncircular spindle 24.

An adjustable shank adapter 36 which is slidably mounted on the spindle 24 includes a bore 38 and an enlarged counterbore 40. The bore 38 in the adjustable shank adapter 36 has a cross-sectional configuration to mate with the cross-sectional configuration of the inside spindle 24 to be rotatable therewith, and in the case of the preferred embodiment, is square-shaped. A knob retainer 42 is mounted in the enlarged counterbore 40 of the adjustable shank adapter 36 and includes a catch 44 which is spring biased radially outwardly through an opening in the side wall of the adjustable shank adapter 36 by a spring member 46. The adjustable shank adapter 36 is inserted on the inside spindle 24 until its forward end portion 48 is snuggly received in the bushing portion 10 of the inside adapter plate 8 with the enlarged counterbore 40 facing away from the door 4.

Figure 2:
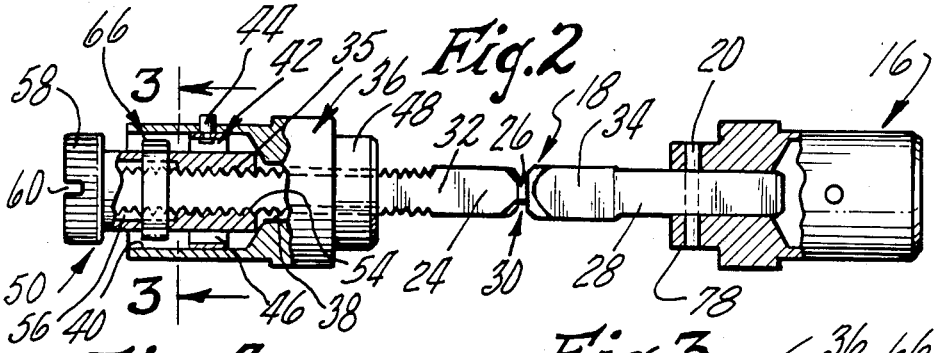
FIG. 2 is an enlarged view of the working trim partially in section.
Figure 4:
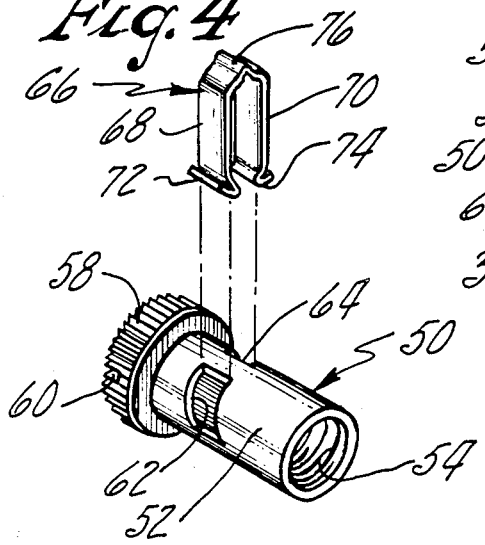
FIG. 4 is an exploded view of the adjustable lock nut.

An adjustable lock nut 50 is provided which includes an enlongated body portion 52 having a forward bore 54, a rearward enlarged counterbore 56, and a head portion 58 at the rear provided with a slot 60 therein as shown in FIG. 2 and 4. Two diametrically opposed portions of the body portion 52 are cut away to form openings 62 and 64 in the wall of the body portion 52 as shown in FIG. 4.

Figure 3:
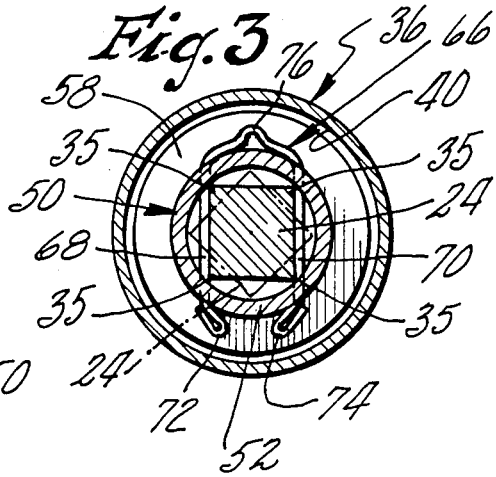
FIG. 3 is a sectional view taken along the lines 3—3 of FIG. 2.

A generally U-shaped spring clip 66 is mounted on the body portion 52 of the lock nut 50 with the side portions 68 and 70 thereof being positioned within the openings 62 and 64, respectively. The spring clip 66 has ears 72 and 74 at the lower end of each side portion 68 and 70 which engage the body portion 52 as shown in FIG. 3. When the adjustable lock nut 50 is threaded onto the spindle 24, the side portions 68 and 70 engage the flat portions of the spindle 24 as shown in FIG. 3. As the adjustable lock nut 50 is rotated, the corners of the spindle 24 engage the side portions 68 and 70 of the spring clip and move the side portions 68 and 70 thereof outwardly against the spring force thus providing a spring detent for the adjustable locking nut 50.

The top portion of the spring clip 66 includes an upwardly extending peak 76 which may engage the wall of the counterbore 40 in the adjustable shank adapter 36 during rotation of the lock nut 50. The peak 76 will prevent the spring clip 66 from riding up on the body portion 52 of the adjustable lock nut 50 during rotation thereof caused by the engagement of the corners of the spindle 24 with the side portions 68 and 70 of the spring clip 66 which could result in the ears 72 or 74 riding up into the openings 62 and 64.

With proper openings cut in the door and the lock 2 inserted, the adapter plates 6 and 8 and the outer rose or escutcheon plate 12 and sleeve 14 may be installed. After ensuring that the proper gap 30 is provided between the head portions 32 and 34 of the inside and outside spindle 24 and 28, the spindle assembly 18 may be inserted through the outside adapter 6 through the door until forward portion 78 of the shank adapter 16 is received within the bushing portion of the outside adapter plate 6. The adjustable shank adapter 36 may then be slid onto the inside spindle 24 until its forward portion 48 is received within the bushing portion 10 of the inside adapter plate 8. The lock nut 50 may then be applied and hand tightened onto the inside spindle 24 against the bottom of the counterbore 40 of the shank adapter 36, making sure that both shank adpaters 16 and 36 fit snuggly in the bushing portion of their respective adapter plates 6 and 8. The lock nut 50 may then back off a quarter or a half a turn to prevent binding.

A rose or escutcheon plate 80 may then be placed over the inside adapter plate 8 against the inner surface of the door 4 and a sleeve 82 threaded onto the bushing portion 10 of the inside adapter plate 8. An inside knob 84 can be slipped onto the shank adapter 36 until it reaches the catch 44 of the knob retainer 42. The catch 44 may then be depressed and the knob 84 be pushed thereover until the catch 44 engages an opening 86 in the knob 84. With this arrangement, operation of either knob 22 or 84 will cause rotation of its respective shank adapter 16 or 36, which in turn will cause rotation of its respective spindle 28 or 24 to operate the latch bolt of the locks depending upon the setting of the lock.

While reference has been made above to a specific embodiment, it will be apparent to those skilled in the art that various modifications and alterations may be made thereto without departing from the spirit of the present invention. Therefore, it is intended that the scope of this invention be ascertained by reference to the following claims.

What is claimed is:

1. Working trim for a door lock for a door, said trim including an adapter plate mounted on said door, a noncircular spindle extending from said door through said adapter plate, a shank adapter slidably received on said spindle for rotation therewith, retaining means positioned on the noncircular spindle for axially retaining said shank adapter on said spindle in one direction and said adapter plate retaining said shank adapter in the other direction, said retaining means and said adapter plate sandwiching said shank adapter therebetween for preventing axial movement of said adapter, lock operating means removably mounted on said shank adapter for rotation therewith, said shank adapter being radially spaced from said retaining means for receiving a radially extending retaining member biased radially outward into engagement with said lock operating means for removably mounting said lock operating means on said shank adapter.

2. The working trim according to claim 1 wherein said spindle has a threaded end portion and said retaining means includes an adjustable lock nut threaded on said spindle.

3. The working trim according to claim 2 wherein said retaining means includes a spring clip mounted on said lock nut in engagement with said spindle.

4. The working trim according to claim 1 wherein said shank adapter has a bore therein having a cross-section mating with the cross-section of the spindle and an enlarged counterbore facing away from said door, said retaining means including an adjustable lock nut threaded on said spindle and engaging the bottom of said counterbore in said shank adapter.

5. The working trim of claim 4 wherein said spindle has a square cross-section.

6. The working trim of claim 1 wherein said adapter plate includes a bushing portion extending outwardly from said door, said retaining means retaining the forward end of the said shank adapter in said bushing portion.

7. Working trim for a door lock for a door, said trim including first and second adapter plates, one mounted on the outside and one mounted on the inside of the door, a swivel spindle assembly extending through said door and said adapter plates including a first and second spindle threadedly attached to each other, a first shank adapter affixed to said first spindle, a lock operator mounted on said first shank adapter for rotation therewith, said second spindle having a noncircular cross-section, a second shank adapter slidably received on said second spindle for rotation therewith, adjustable retaining means positioned on said noncircular spindle for axially retaining said second shank adapter on said second spindle in one direction and said second adapter plate retaining said second shank adapter in said other direction, said retaining means and said second adapter plate sandwiching said second shank adapter therebetween for preventing axial movement of said second adapter, a second lock operator removably mounted on said second shank adapter for rotation therewith, said second shank adapter being radially spaced from said retaining means for receiving a radially extending retaining member biased radially outward into engagement with said second lock operator for removably mounting said lock operator on said second shank adapter.

8. The working trim according to claim 7 wherein said second spindle has a threaded end portion extending from said door and said retaining means includes an adjustable lock nut threaded on said second spindle.

9. The working trim according to claim 8 wherein said retaining means includes a spring clip mounted on said lock nut in engagement with said second spindle.

10. The working trim according to claim 7 wherein said second shank adapter has a cross-section mating with the cross-section of said second spindle and an enlarged counterbore facing away from said door, said retaining means including an adjustable lock nut threaded on said second spindle and engaging the bottom of said counterbore in said shank adapter.

11. The working trim of claim 10 wherein said second spindle has a square cross-section.

12. The working trim of claim 9 wherein said first and second adapter plates each includes a bushing portion extending outwardly from said door, said retaining means retaining the forward end of each of said shank adapters in the bushing portion of its respective adapter plate.

* * * * *